United States Patent [19]

Pearson

[11] B 3,996,711

[45] Dec. 14, 1976

[54] WALLS

[75] Inventor: Jonathan Clive Pearson, Sheffield, England

[73] Assignee: Ellis Pearson & Co. Limited, Great Britain

[22] Filed: Apr. 10, 1974

[21] Appl. No.: 459,597

[44] Published under the second Trial Voluntary Protest Program on February 17, 1976 as document No. B 459,597.

[30] Foreign Application Priority Data

Apr. 12, 1973 United Kingdom ..... 17571/73

[52] U.S. Cl. ..... 52/207; 52/308; 52/457

[51] Int. Cl.[2] ..... E06B 1/04; E04B 5/56; E06B 3/70

[58] Field of Search ..... 792/DIG. 63; 52/204, 52/308, 202, 457, 458, 758 A, 206–209, 311–316; 49/399, 400, 495

[56] References Cited

UNITED STATES PATENTS

| | | | |
|---|---|---|---|
| 982,226 | 7/1911 | Good | 292/DIG. 63 |
| 1,619,811 | 3/1927 | Coryell | 52/457 |
| 1,799,482 | 4/1931 | Schlacks | 52/207 |
| 1,987,380 | 1/1935 | Triller | 52/509 |
| 2,059,489 | 11/1936 | Reisig | 52/314 |
| 2,173,758 | 9/1939 | Lynch et al. | 52/207 |
| 2,191,500 | 2/1940 | Rosling | 52/202 |
| 2,197,195 | 4/1940 | Schemers | 292/DIG. 63 |
| 3,006,041 | 10/1961 | Thuet et al. | 52/204 |
| 3,189,140 | 6/1965 | Luss | 49/399 |
| 3,340,661 | 9/1967 | Krieger | 52/311 |
| 3,352,078 | 11/1967 | Neal | 52/495 |
| 3,430,384 | 3/1969 | Malenfant | 49/400 |
| 3,720,025 | 3/1973 | Eichman | 52/204 |

*Primary Examiner*—James L. Ridgill, Jr.
*Attorney, Agent, or Firm*—Lowe, King, Price & Markva

[57] ABSTRACT

A glass wall, in particular for a sports area, is formed of toughened glass sheets and drilling of the sheets obviated or minimised by assembling the glass sheets edge-to-edge, with a pair of resiliently lined side channels fitted to the end pair of glass edges and with resiliently lined top and bottom channels fitted to the top and bottom edges respectively of the glass sheets, each pair of abutting glass edges being overlapped by a pillar with a resilient strip in between, and a door may be formed by a glass sheet with pivots secured to the door and the top and bottom channels or the top and bottom of an opening in a wall to which the channels are secured, with a small hole in the door for access to a latch carried by the door and engageable with one of the pillars flanking the door.

9 Claims, 10 Drawing Figures

WALLS

This invention relates to walls, more particularly — but not exclusively — for sports areas, such as squash courts, and has for its object the provision of a wall substantially of glass, which may be included in the playing area or otherwise may be struck by a ball or other object.

It is already known to form a back wall of a squash court substantially of toughened glass comprising at least two fixed sheets of glass and usually also one on vertical pivots to form a door, with buttresses of glass (or other material) on the outside, e.g., where the sheets of glass abut each other. However, this construction necessitates drilling of all the sheets of glass to enable fixtures and fittings to be secured to them, and the provision of buttresses of glass calls for some expensive work also in finishing the buttresses. Furthermore, this form of construction is also rather limited in height, without providing another tier of glass sheets, so it has been the practice to keep to 7 feet above the floor, this being the height of the playing area on the back wall of a squash court.

The primary object of the invention is to provide an assembly for forming a wall substantially of glass at lower cost by eliminating the need to drill holes in the sheets of glass for securing them and the polishing of the edges. A secondary object is to enable greater heights of glass walls to be attained than hitherto, without loss of strength.

According to the present invention, an assembly for forming a wall substantially of glass comprises a plurality of glass sheets disposed edge-to-edge, a pair of side channels with resilient linings fitted to the end pair of glass edges, a bottom channel with a resilient lining fitted along the bottom edges of the glass sheets, a top channel with a resilient lining fitted along the top edges of the glass sheets, and a pillar overlapping each pair of abutting glass edges and spaced therefrom by a resilient strip.

Thus, the glass sheets are located securely but resiliently along their top and bottom edges by the lined top and bottom channels, which can be secured along the top and bottom edges of an opening in a wall, and the pillars provide intermediate supports, so that the abutting edges of the glass sheets are maintained in close relationship with each other, and so none of the glass edges needs to be drilled or polished. Although the pillars do obstruct the view through the assembly, they need not be of any appreciable width, but in any case they are disposed at the outside (or "spectactor side") of the wall, and therefore, in the case of a squash court or other sports area need not interfere with play.

The top channel may be self-supporting, as is convenient for a back wall of a squash court over which the court is also to be viewed, in which case the top channel can define the height of the playing area, but the top channel would preferably be secured along the top edge of an opening in a wall, to a beam for a floor above, or to the underside of a balcony, in which case the glass sheets can be a lot taller than hitherto (e.g., up to say 13 feet above the floor) because of the better support afforded both by the secured top channel and the pillar extending along each pair of abutting upright glass edges, and the height of the playing area may be indicated by a line across the glass sheets. Although the wall above the openings will obstruct the view from some angles, the increase in height of the glass attainable compensates very substantially for any slight loss. Whereas previously it was usual to provide spectator accommodation generally above the top of a back wall of a squash court, with changing rooms below, following conventional construction of squash courts and spectator accommodation, the invention facilitates the provision of spectator accommodation at or from ground level, with consequent increase in spectator accommodation and/or simplification of building construction.

A door may be accommodated in the assembly by providing a glass sheet that does not fit the top and bottom channels but which is secured to pivots secured to the top and bottom channels, with a small hole in the door for access to a latch carried by the door and engageable with one of the pillars flanking the door, which pillar may provide abutment through the resilient strips for the edge of the door when closed.

The abutting edges of the glass sheets, other than those including an edge of a door, may be sealed with a suitable sealing compound, e.g., clear silicone seal.

The channels are conveniently formed by channel-section metal, e.g., extruded aluminium, and the top and bottom channel-sections may be cut-away for location of the pillars (if the resilient strips of the latter have the same thickness as the linings of the channels) and for location of pivot mountings for a door. The pillars are conveniently formed by rolled hollow sections, e.g., of steel, chrome plated to match the door fittings, or painted or stove-enameled.

An embodiment of the invention will now be described, by way of example only, with reference to the accompanying drawings, in which.

Figure 1:
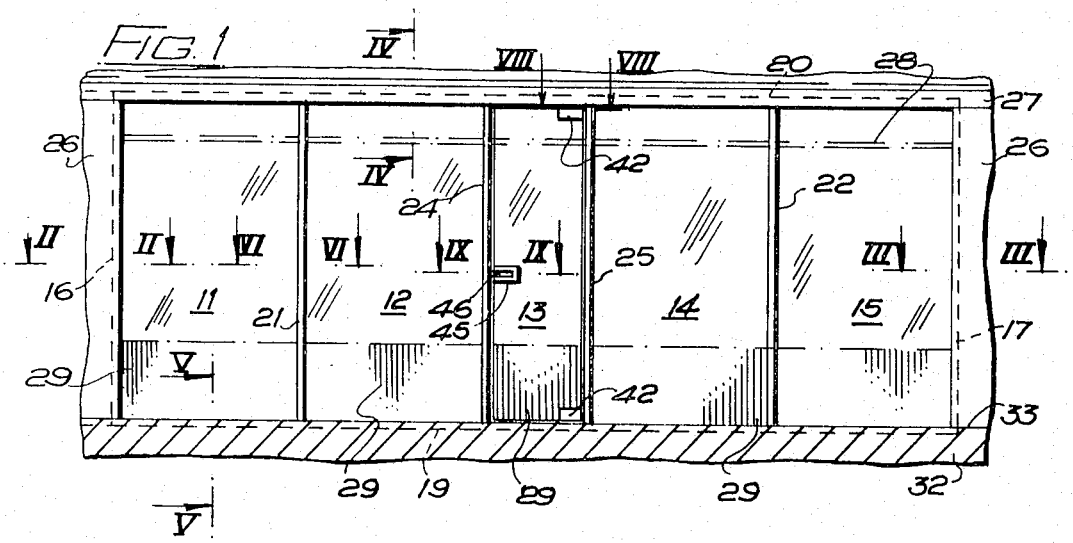
FIG. 1 is a diagrammatic elevation of an assembly in accordance with the invention included in the playing area of a squash court.
Figure 2:
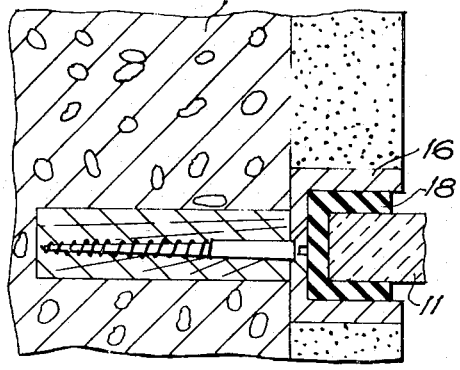
FIGS. 2 to 6 are enlarged fragmentary sections on the lines II—II to VI—VI of FIG. 1.
Figure 4:
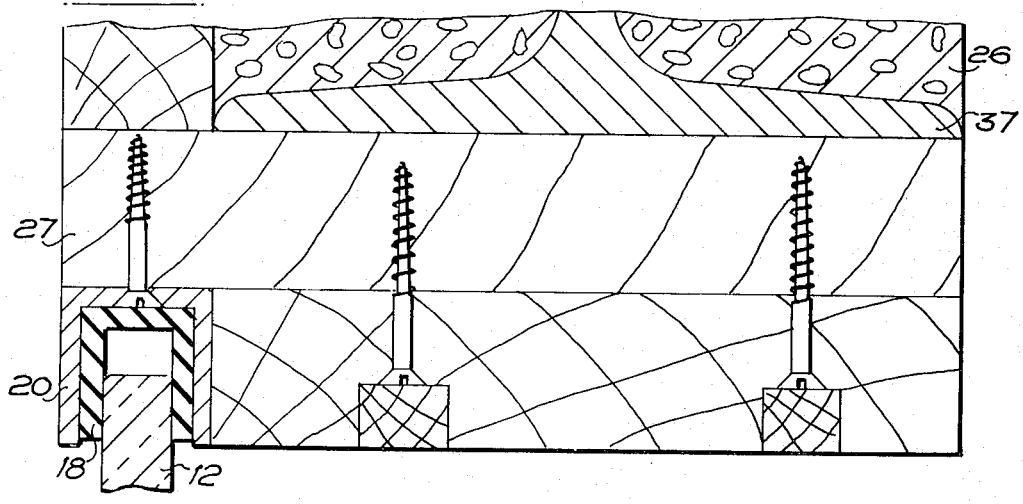
Figure 5:
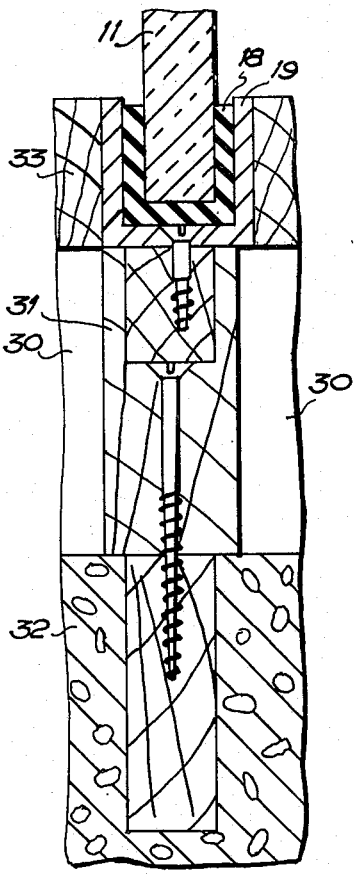
Figure 7:
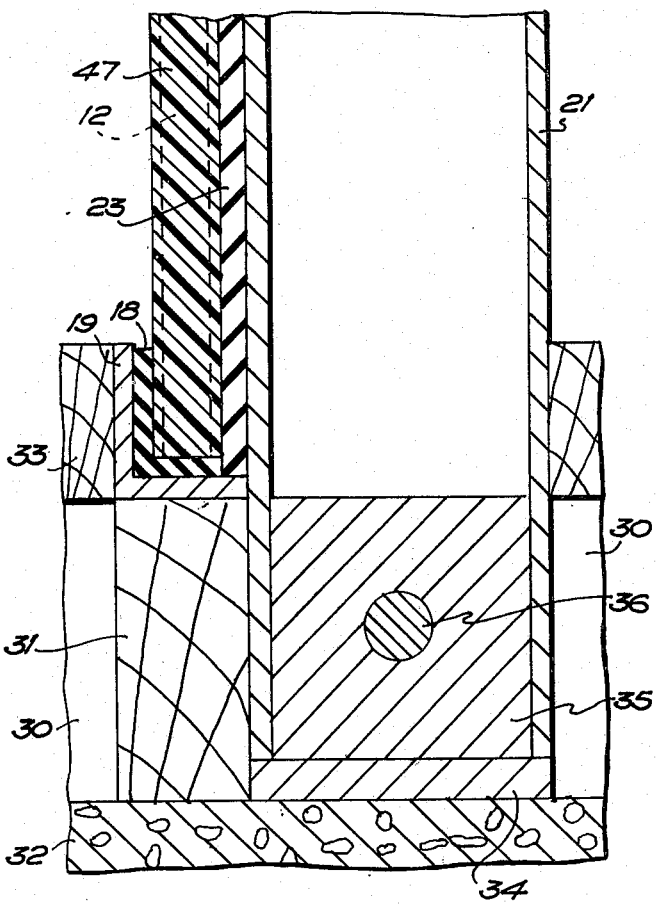
FIG. 7 is a fragmentary section on the line VII—VII of FIG. 6.
Figure 6:
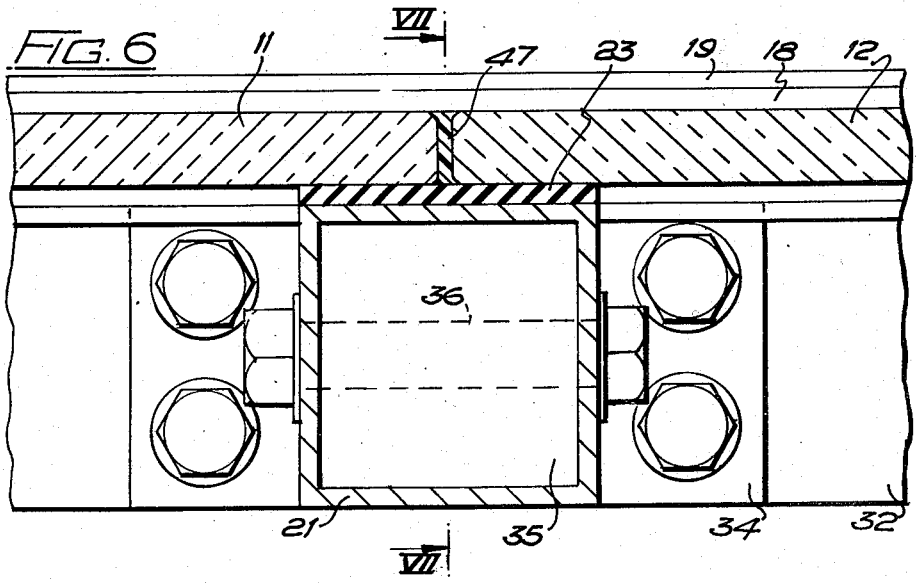
Figure 8:
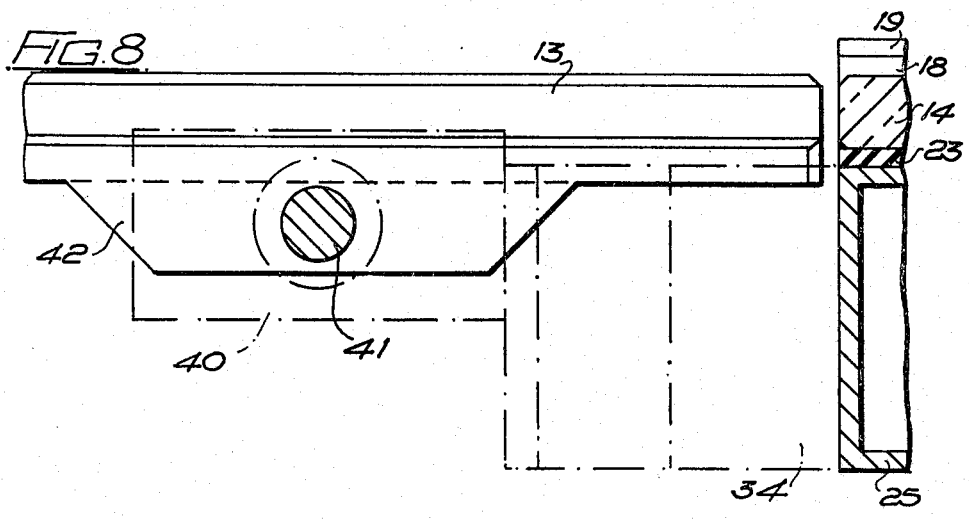
FIGS. 8 and 9 are enlarged fragmentary sections on the lines VIII—VIII and IX—IX of FIG. 1.
Figure 9:
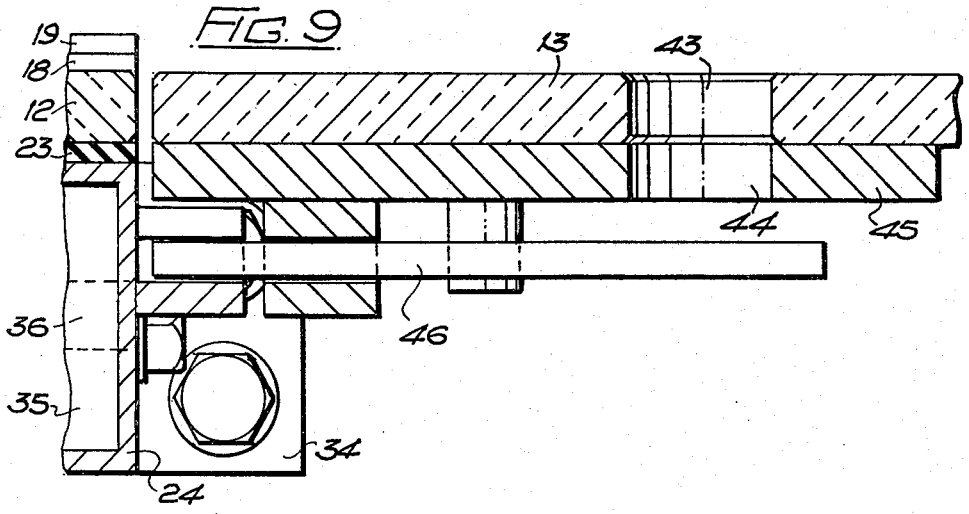

In FIG. 1 an assembly for forming a wall substantially of glass comprises a plurality of toughened glass sheets 11 to 15 disposed edge-to-edge (with the sheets 11, 12 abutting each other and the sheets 14, 15 abutting each other, but with clearance all round the sheet 13, which forms a door), a pair of side channels 16, 17 with resilient linings 18 fitted to the end pair of glass edges (see also FIGS. 2 and 3), a bottom channel 19 with a resilient lining 18 fitted along the bottom edges of the glass sheets 11, 12, 14, 15 (see also FIG. 5), a top channel 20 with a resilient lining 18 fitted along the top edges of the glass sheets 11, 12, 14, 15 (see also FIG. 4), a pair of pillars 21, 22 overlapping the respective pairs of abutting glass edges of the sheets 11, 12 and 14, 15 respectively and each spaced therefrom by a resilient strip 23 (see also FIGS. 6 and 7), and a pair of pillars 24, 25 overlapping the glass edges of the sheets 12, 14 adjacent to the sheet 13 and each spaced therefrom by a resilient strip 23 (see also FIGS. 8 and 9).

The glass sheets 11, 12, 14, 15 are located securely but resiliently along their top and bottom edges by the lined top and bottom channels 20, 19, which are secured along the top and bottom edges of an opening in a wall 26, and the pillars 21, 22, 24, 25 provide intermediate supports, with the abutting edges of the glass sheets 11, 12 and 14, 15 respectively maintained in close relationship with each other by the pillars 21, 22, and with the edges of the glass sheets 12, 14 adjacent the door 13 firmly supported. None of the glass edges of the sheets 11, 12, 14, 15 therefore needs to be drilled or polished. Although the pillars do obstruct the view through the assembly, they are not of any appreciable width, but in any case they are disposed at the outside (or "spectator side") of the wall, and therefore do not interfere with play.

The top channel 20 could be self-supporting in the case of the back wall of a squash court over which the court is also to be viewed, but in the embodiment shown in the drawings the top channel is secured to a hardwood facing 27 along the top edge of the opening in the wall 26, and the height of the playing area is indicated by a line 28 across all the glass sheets. Vertical lines are etched on lower portions 29 of all the glass sheets to afford players an awareness of the proximity of the glass wall when turning to play lower shots, but without noticeably impairing the view through the glass wall.

The bottom channel 19 is secured to joists 30 and packing 31 between the joists which are secured to a concrete base 32 and covered with a hardwood flooring 33. Also secured to the concrete base 32 are plates 34 with square spigots 35 fitting the lower ends of the hollow pillars 21, 22, 24, 25 and secured thereto, by bolts 36, similar plates, spigots and bolts (not shown) being provided for securing the upper ends of the pillars to a steel girder 37 (FIG. 4) spanning the opening in the wall 26.

Figure 3:
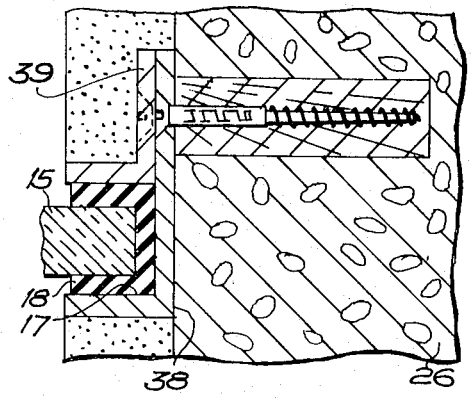

The channels 16, 17, 19, 20 are conveniently formed by channel-section metal, e.g., extruded aluminium, but FIG. 3 shows an alternative construction using two angle-sections 38, 39, and the top and bottom channels 20, 19 are cut-away for location of the pillars 21, 22, 24, 25 (the resilient strips 23 of which have the same thickness as the linings 18 of the channels) and for location of pivot mountings 40 for the door. The pivots 41 are carried by brackets 42 bolted to the door, which is provided with appropriate holes (not shown). The door also has a hole 43 with which is aligned a hole 44 in a plate 45 carrying a latch 46, engageable with the pillar 24, with the holes 43, 44 affording access to the latch from the court.

The abutting edges of the glass sheets 11, 12 and 14, 15 respectively are sealed with a suitable sealing compound 47 (FIGS. 6 and 7), e.g., clear silicone seal.

Figure 10:
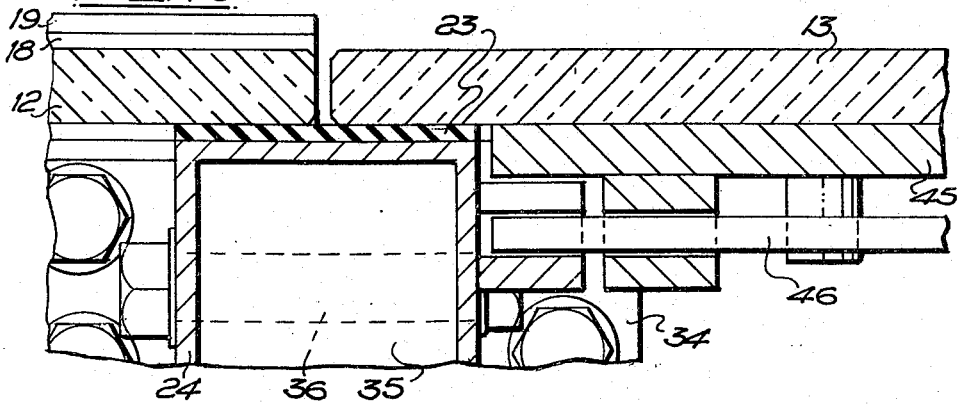
FIG. 10 corresponds to FIG. 9 but shows a slight modification.

With the modifications shown in FIG. 10, the pillar 24 provides abutment through the resilient strip 23 for the edge of the door 13 when closed.

What I claim is:

1. An assembly for forming a wall substantially of glass comprising a plurality of glass sheets in abutment to each other, a pair of side channels with resilient linings fitted to the end pair of glass edges, a bottom channel with a resilient lining fitted along the bottom edges of the glass sheets, a top channel with a resilient lining fitted along the top edges of the glass sheets, a pillar overlapping each pair of abutting glass edges on only one side of said glass sheets and spaced therefrom by a resilient strip to provide intermediate support for said glass sheets, a door comprising a glass sheet, pivots secured to the door and to the top and bottom channels, a pair of pillars flanking the door, and a latch carried by the door and engageable with one of the pillars flanking the door, the door being provided with a small hole for access to the latch from the face of the door remote from the latch.

2. An assembly for forming a wall substantially of glass comprising a plurality of glass sheets substantially in lateral edge-to-edge abutment to each other, a pair of side channels with resilient linings fitted to the end pair of glass edges, each intermediate lateral edge of said sheets being free of support other than from the abutting edge of the adjacent sheet, a bottom channel with a resilient lining fitted along each of the bottom edges of the glass sheets, a top channel with a resilient lining fitted along each of the top edges of the glass sheets, and a pillar overlapping each pair of abutting glass edges, said pillar located on only one side of said glass sheets and spaced therefrom by a resilient strip to provide intermediate support for said glass sheets, the opposite side of said sheets providing a planar face free of projections.

3. An assembly as in claim 1, wherein the abutting edges of the glass sheets are sealed with a suitable sealing compound.

4. An assembly as in claim 1, wherein a door is accommodated in the assembly by providing a glass sheet that is secured to pivots secured to the top and bottom channels, with a small hole in the door for access to a latch carried by the door and engageable with one of the pillars flanking the door.

5. An assembly as in claim 4, wherein the pillar with which the latch is engageable provides abutment through the resilient strip for the edge of the door when closed.

6. An assembly as in claim 1, including a channel support structure, and means for fastening the top channel to a surface of said support structure.

7. An assembly as in claim 6, wherein said support structure includes a beam for a floor above.

8. An assembly as in claim 6, wherein said support structure includes the underside of a balcony.

9. An assembly as in claim 6, wherein a height of the playing area is indicated by a line across the glass sheets.

* * * * *